US006279432B1

(12) United States Patent
Osborn et al.

(10) Patent No.: US 6,279,432 B1
(45) Date of Patent: Aug. 28, 2001

(54) FORCE MULTIPLICATION HAND TOOL

(75) Inventors: Merritt Armstrong Osborn, Aurora; Russell James Logan, Pepper Pike, both of OH (US)

(73) Assignee: Merritt Armstrong Osborn

( * ) Notice: Subject to any disclaimer, the term of this patent is extended or adjusted under 35 U.S.C. 154(b) by 0 days.

(21) Appl. No.: 09/328,985

(22) Filed: Jun. 9, 1999

(51) Int. Cl.[7] ..... B25B 7/04

(52) U.S. Cl. ..... 81/383; 81/342; 81/375; 81/367; 81/415

(58) Field of Search ..... 81/383, 342, 367, 81/375, 381, 415–416

(56) References Cited

U.S. PATENT DOCUMENTS

| | | | | |
|---|---|---|---|---|
| 146,829 | | 1/1874 | Lindsay . | |
| 1,541,248 | * | 6/1925 | Carlson | 81/383 |
| 1,709,378 | * | 4/1929 | Sulger | 81/383 |
| 2,327,368 | | 8/1943 | Olson . | |
| 2,692,384 | | 10/1954 | Pollock . | |
| 3,422,708 | | 1/1969 | Bieganski . | |
| 3,600,986 | | 8/1971 | Baldwin, Jr. . | |
| 3,807,718 | | 4/1974 | Sendoykas . | |
| 4,351,097 | | 9/1982 | Hashimoto et al. . | |
| 5,267,464 | * | 12/1993 | Cleland | 81/383 |
| 5,280,716 | * | 1/1994 | Ryan et al. | 81/383 |
| 5,375,330 | | 12/1994 | Hermann . | |

* cited by examiner

*Primary Examiner*—Joseph J. Hail, III
*Assistant Examiner*—Lee Wilson
(74) *Attorney, Agent, or Firm*—Patrick J. Daugherty; Driggs, Lucas, Brubaker & Hogg Co., LPA

(57) ABSTRACT

A hand tool comprising a first handle member with integral jaw, a second handle member, and a third jaw member, all three members pivotally connected by a single common pivot pin. All three members are also cooperatively connected by a force multiplying mechanism, wherein an operative force applied to the handles is multiplied and applied to a work piece by the jaws. One embodiment of the invention features a "U"-shaped handle with two common pivot pin connection points, providing structural strength and handling stability. Other embodiments also comprise power assist devices to provide electrical and pneumatic work piece manipulation forces.

17 Claims, 11 Drawing Sheets

FORCE MULTIPLICATION HAND TOOL

FIELD OF THE INVENTION

The invention relates generally to hand tools for cutting, crimping, gripping, spreading and otherwise working upon a work piece, and more particularly to such tools which have pivoting jaws and handles.

BACKGROUND OF THE INVENTION

Hand tools that use leverage for acting upon a work piece are well known. Tools such as scissors, pliers, tin snips, and crimping tools function by varying the amount of pressure applied to a work piece by varying the amount of pressure applied by the user's hands to the tools. When a task requires an increase in force, more force must be correspondingly supplied by the user through an increase in muscular force applied to the tool.

Utilizing a hand tool generally requires a two-phase cycle. In the first phase, the tool is engages the work piece. In the second phase, the tool performs the desired task upon the work piece, such as gripping or spreading. The first phase requires comparatively less effort and more tool element movement or travel than the second working phase. Most common hand tools make no attempt to differentiate between the two phases of the cycle. During the working phase the operator increases the pressure. Slip-joint pliers are good examples of these types of tools.

Another class of tools uses the first type of applied force and a 3 bar mechanism to maximize pressure at the end of the stroke. Examples of this class are a locking action gripping tool such as the Vice-Grip™, or a cutting tool such as compound metal shears.

Still another class of tool use a ratcheting mechanism and an extra squeeze to trade travel for stored force. The Amp Crimper™, which uses 2–3 strokes to reach the desired pressure, is a good example of this type of tool.

A fourth class of tools is power tools, whether air or electric, which generally have so much force available that no attempt is made to control it.

SUMMARY OF INVENTION

According to the present invention, a force multiplying hand tool is provided which includes a first member having a first handle and a first jaw, a second member comprising a second handle, and a third member comprising a second jaw. All three members are pivotally connected by a common pivot pin and all are cooperatively interconnected by a force multiplying mechanism. A force brought to bear upon the handles by a user is leveraged and applied to a work piece by the jaws, wherein the force multiplying mechanism progressively increases the applied force as the handles travel toward each other. The invention applies force to a workpiece positioned within the jaws when configured as a gripping, cutting or crimping tool. Configured as a spreading tool, the invention applies force to a work piece positioned about the tool. The force multiplication increases greatly during the second or "working" phase of the tool's two-phase cycle. The tool thereby applies an increased force to a work piece positioned within or about the jaws of the tool without requiring a corresponding increase in the force applied by the hand tool user. The amount of force applied to a work piece is dependent upon the separation distance of the handle members and the location of the jaws responsive thereto.

Preferably the force multiplying characteristics of the tool are supported by a "U"-shaped handle structure. This handle structure has two pivot post attachment members, thereby providing additional structural strength when compared to a typical hand tool which has only one pivot post connection point. The base of this "U"-shape also forms a wide hand gripping structure for comfort and stability during use of the tool. Various embodiments of the tool also utilize pneumatic or electromagnetic power assist devices to provide work piece manipulation forces.

DETAILED DESCRIPTION OF A PREFERRED EMBODIMENT

Figure 1A:
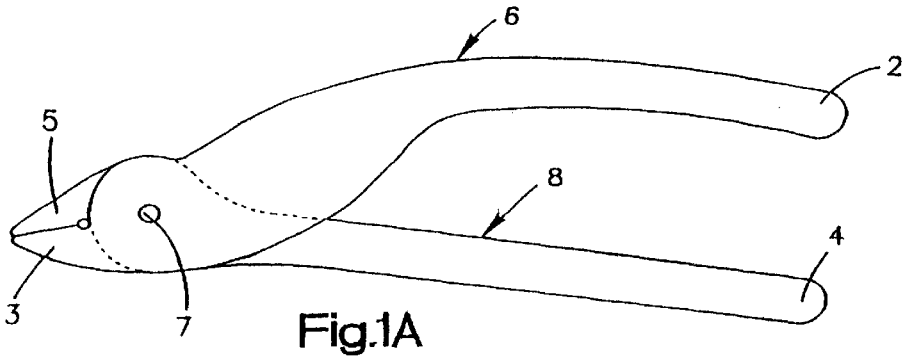
Fig.1A PRIOR ART
FIG. 1A is a side elevation view of a pair of prior art pliers, with the handles and the jaws closed.
Figure 1B:
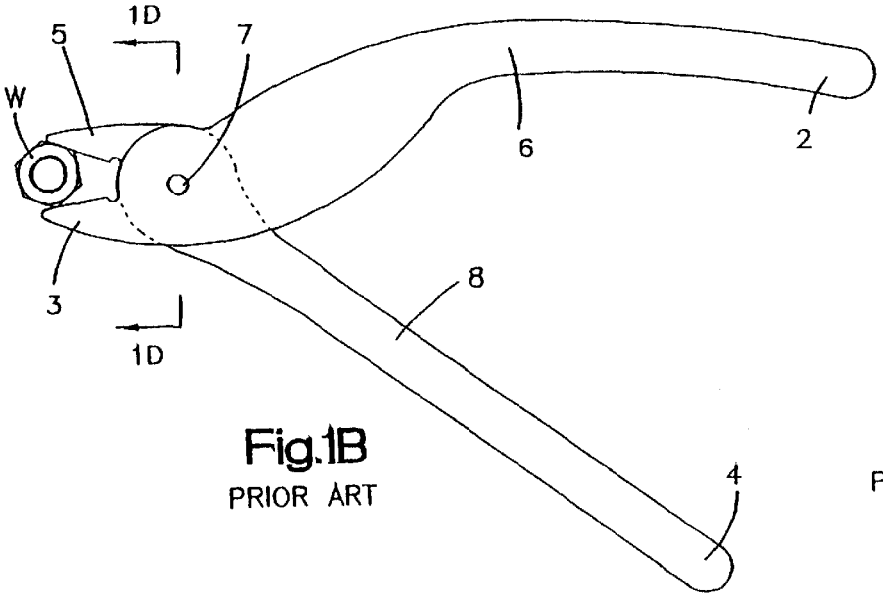
Fig.1B PRIOR ART
FIG. 1B is a side elevation view of the pair of prior art pliers of FIG. 1A with the handles and the jaws open.
Figure 1D:
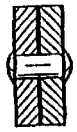
Fig.1D PRIOR ART
FIG. 1C is a graph depicting the relationship of Force Amplification Ratio of the tool of FIGS. 1A and 1B to the position of the tool's handles over the range of pivotal motion of the handles about the pivot pin, from open to closed.
Figure 1C:
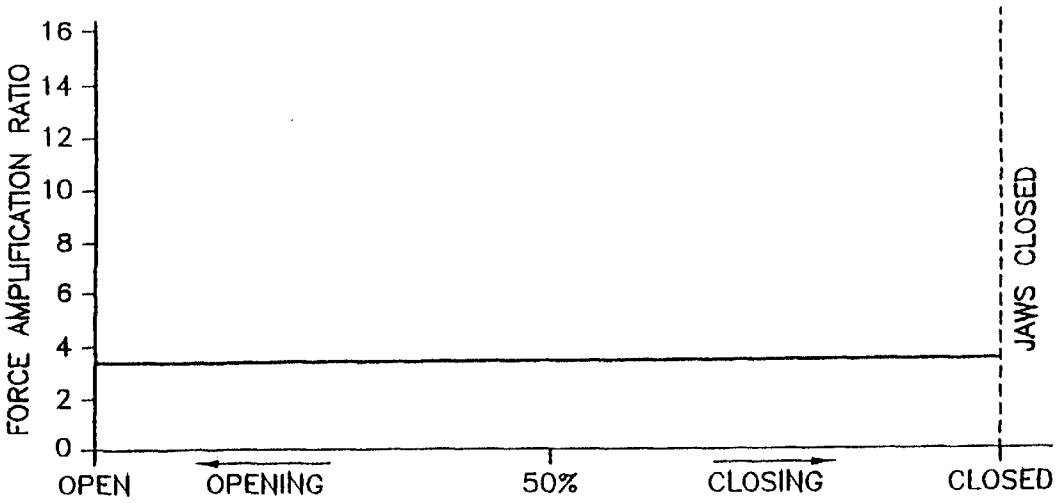
Figure 4A:
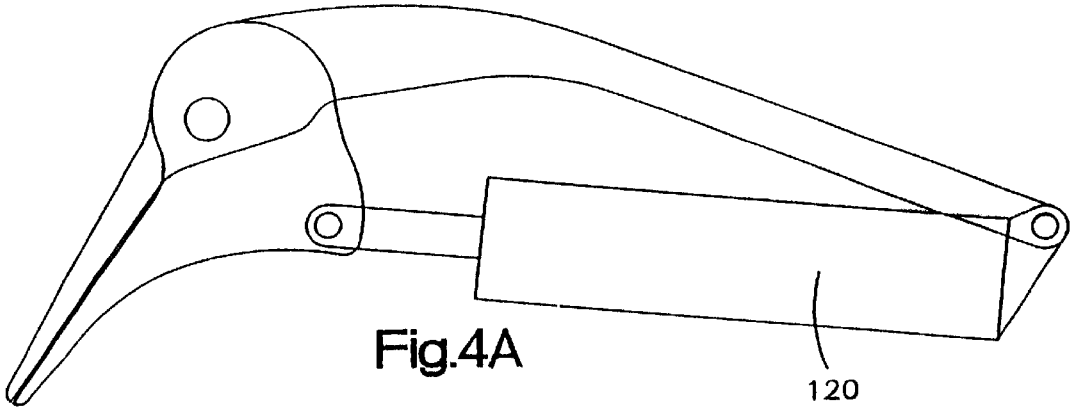
FIG. 4A is a side elevation view of a pair of prior art pliers incorporating a magnetic power assist device, with the handles and the jaws closed.
Figure 4B:
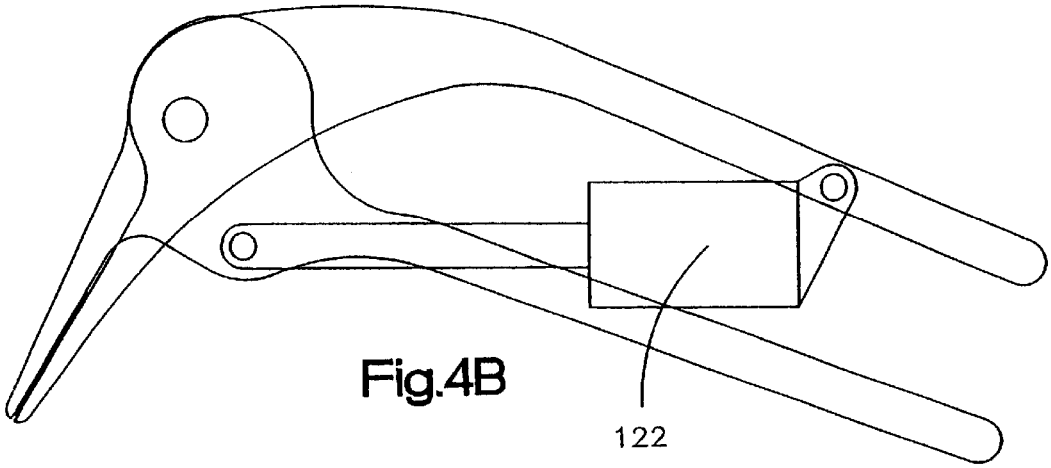
FIG. 4B is a side elevation view of the pair of prior art pliers incorporating a pneumatic power assist device, with the handles and the jaws closed.
Figure 4C:
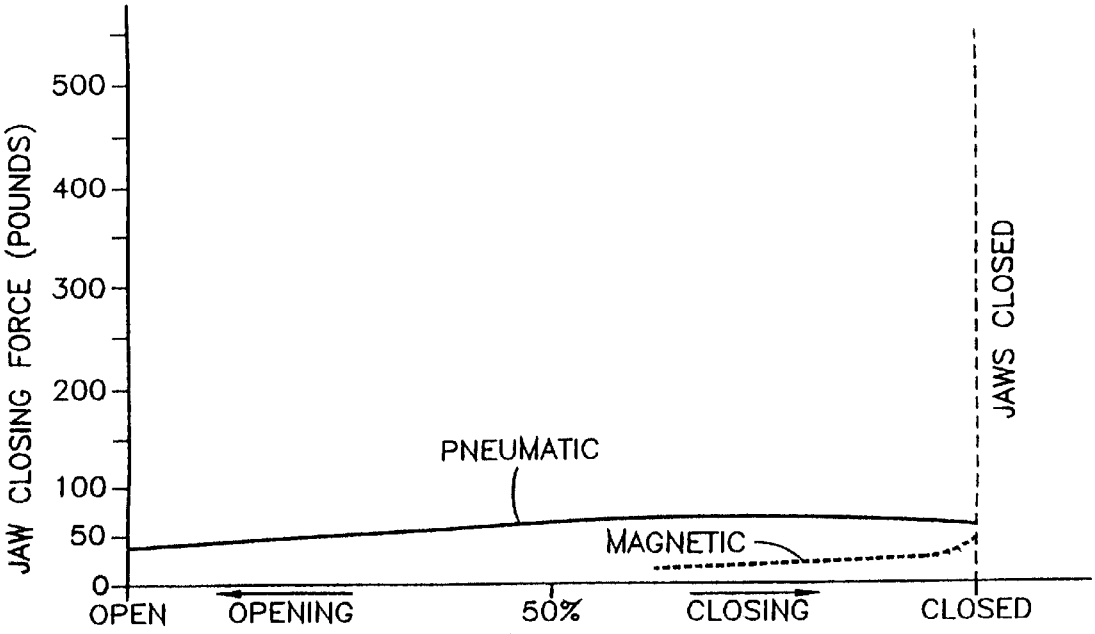
FIG. 4C is a graph depicting the relationship of Force Amplification Ratio of the tools of FIGS. 4A and 4B to the position of the tool's handles over the range of pivotal motion of the handles about the pivot pin, from open to closed.

Referring now to the drawings, and for the present to FIGS. 1A and 1B, a typical leverage-type prior art hand tool is depicted. This tool includes first and second pivotally interconnected levers 6 and 8, each having respectively handle portions 2 and 4 and jaw portions 3 and 5. The pivotal connection is by pivot pin 7. To operate the tool a user exerts force upon handles 2 and 4 to pivot said handles about pivot pin 7 into the closed position, thereby closing the jaws 3 and 5 about a work piece W. Through the principles of leverage well known in the art of hand tools, the force exerted by the user upon the handles 2 and 4 is a amplified and applied to the work piece W positioned within the jaws 3 and 5. The amount of force exerted upon the work piece divided by the amount of force applied by a user to "close" the handles 2 and 4 is the force amplification ratio of the tool. The Force Amplification Ratio does not vary with travel of the tool handles with respect to each other, but remains constant where the applied force is constant, as depicted in the graph in FIG. 1C. The Force Amplification Ratio is the amount of force applied to a work piece positioned within the jaws divided by the amount of force used to bring the handles toward each other about the pivot pin. An embodiment of such a prior art tool incorporating a magnetic power assist device 120 is depicted in FIGS. 4A. Another embodiment of the prior art tool incorporating a pneumatic power assist device 122 is depicted in FIGS. 4B. The force amplification ratio per handle travel distance for the magnetic and pneumatic power assist devices 120 and 122 respectively is depicted in FIG. 4C. As FIG. 4C illustrates, both prior art tools achieve minimal force amplification.

Figure 2:
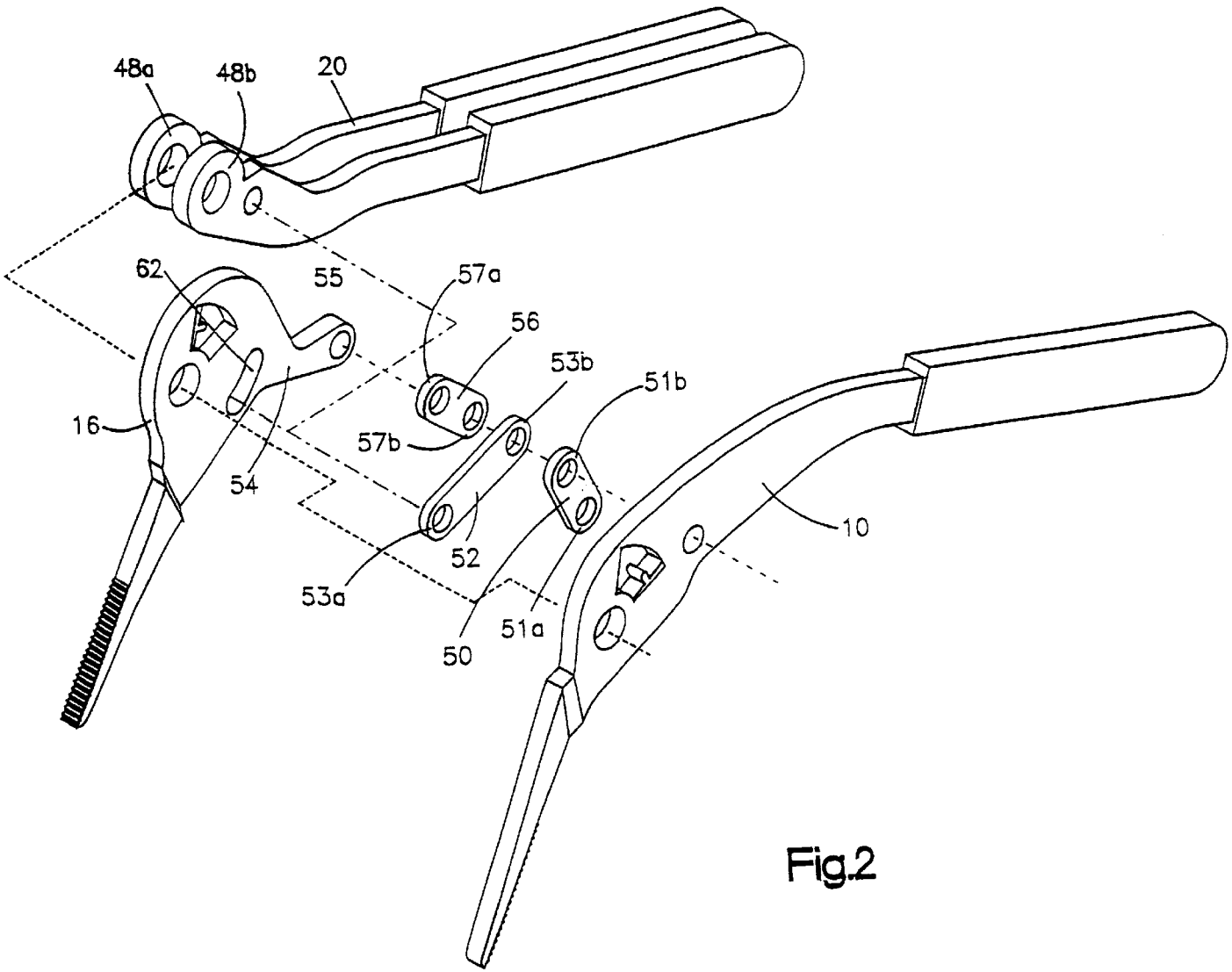
FIG. 2 is an exploded perspective view of one embodiment of the present invention.
Figure 2A:
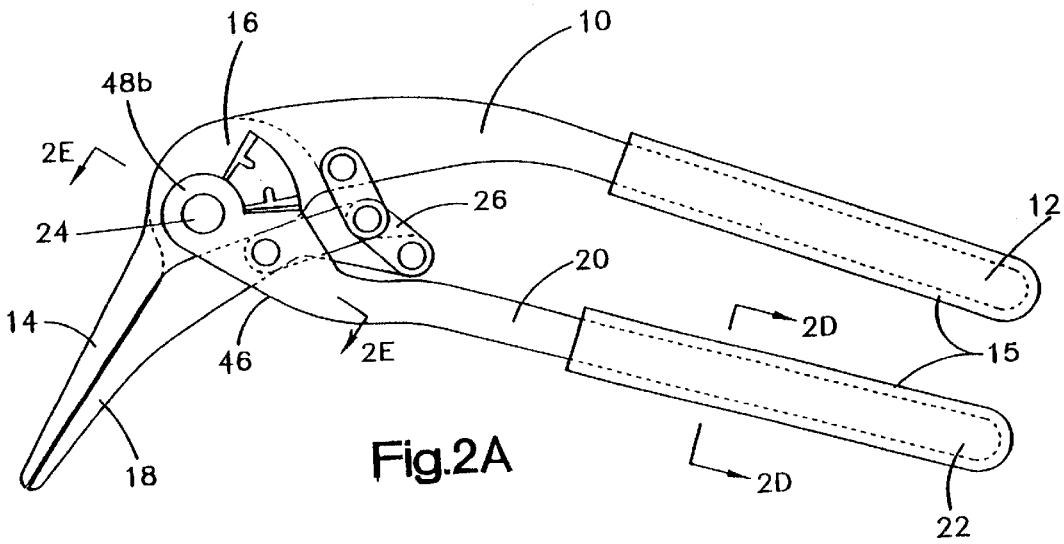
FIG. 2A is a side elevation view of the invention of FIG. 2 with the handles and jaws in closed positions, wherein the force multiplying mechanism is a pin and lever linkage.
Figure 2B:
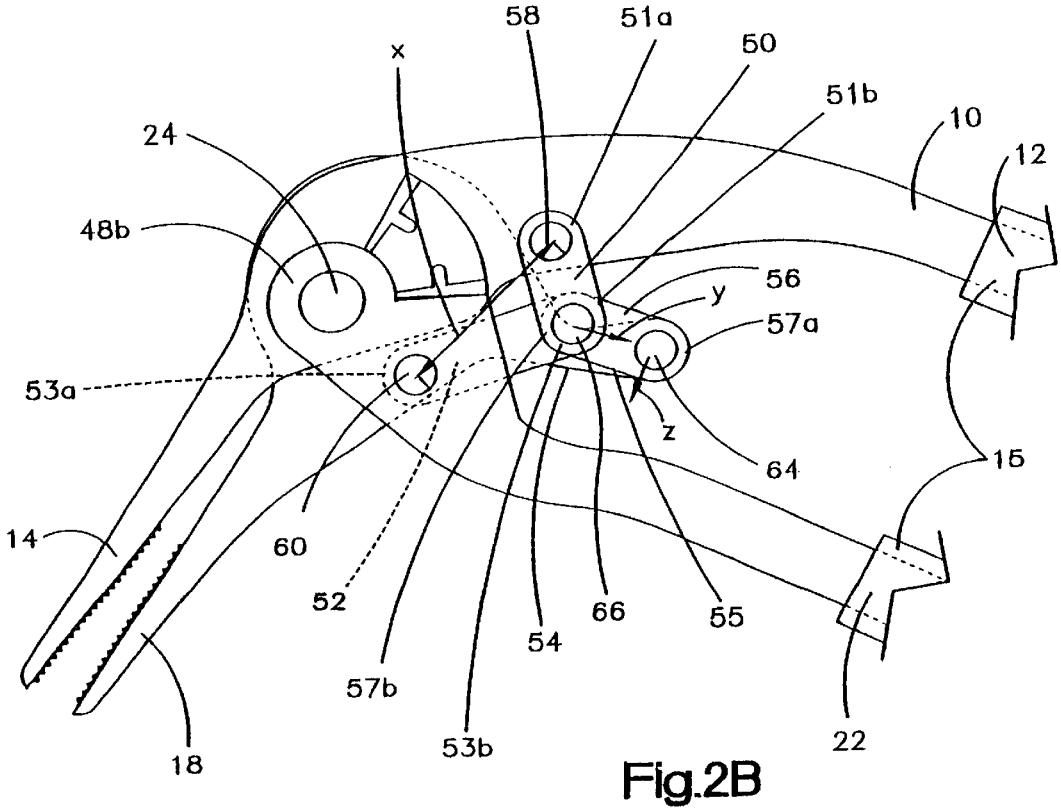
FIG. 2B is a side elevation view of the tool of FIG. 2A with the handles and jaws in an open position.

Referring now to FIGS. 2, 2A and 2B, one embodiment of the present invention is shown which includes a first member 10 having a first handle portion 12 and a first jaw portion 14 integral therewith. A second member 16 includes a second jaw 18, and a third member 20 includes a second handle 22. The first member 10, second member 16 and third member 20 are commonly pivotally connected by a common pivot pin 24. A four bar and pin force multiplying mechanism 26 further interconnects the first, second and third members, which will be described presently.

Figure 2C:
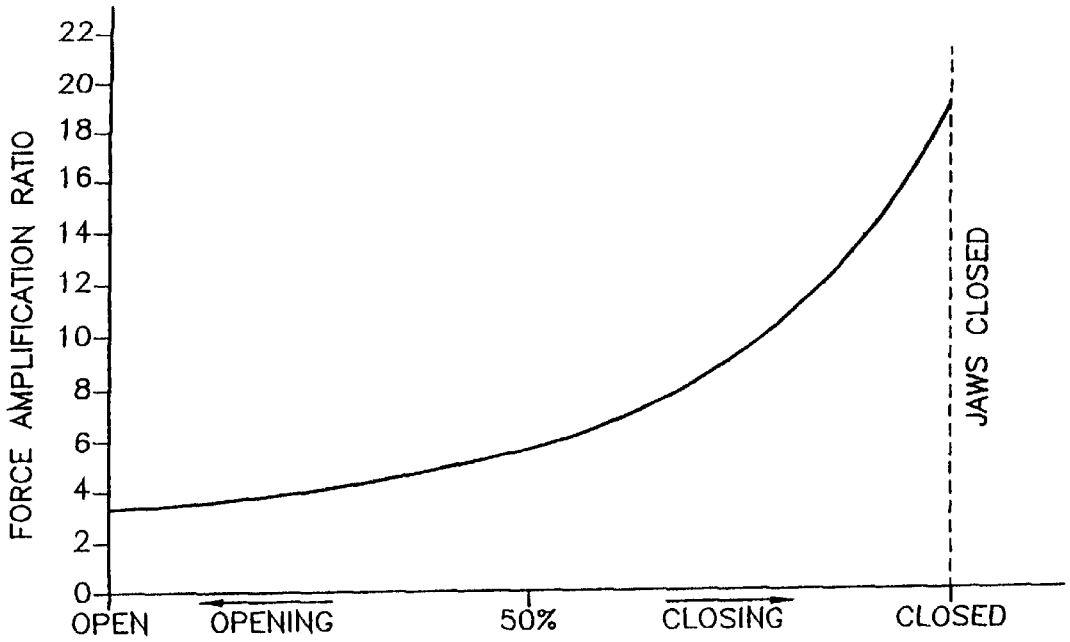
FIG. 2C is a graph depicting the relationship of Force Amplification Ratio of the tool of FIGS. 2A and 2B to the position of the tool's handles over the range of pivotal motion of the handles about the pivot pin, from open to closed.
Figure 2D:
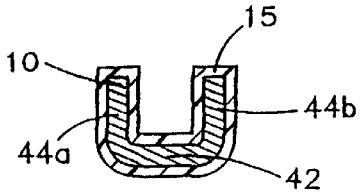
FIG. 2D is a sectional view taken substantially along the plane 2D—2D of FIG. 2A, illustrating the "U"-shaped structure of the handle and it's wide hand gripping base.
Figure 5A:
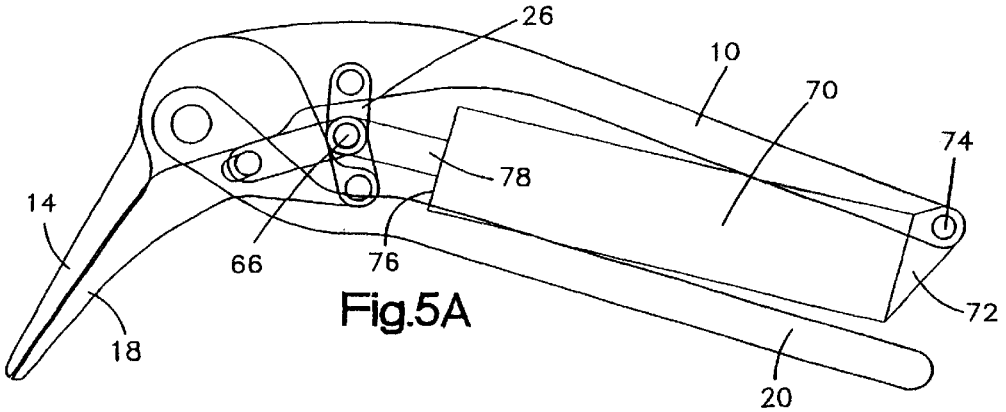
FIG. 5A is a side elevation view of a force multiplying hand tool embodying the present invention with the handles and jaws in closed positions, wherein the force multiplying mechanism is cam linkage, the tool further incorporating a power assist device.
Figure 5B:
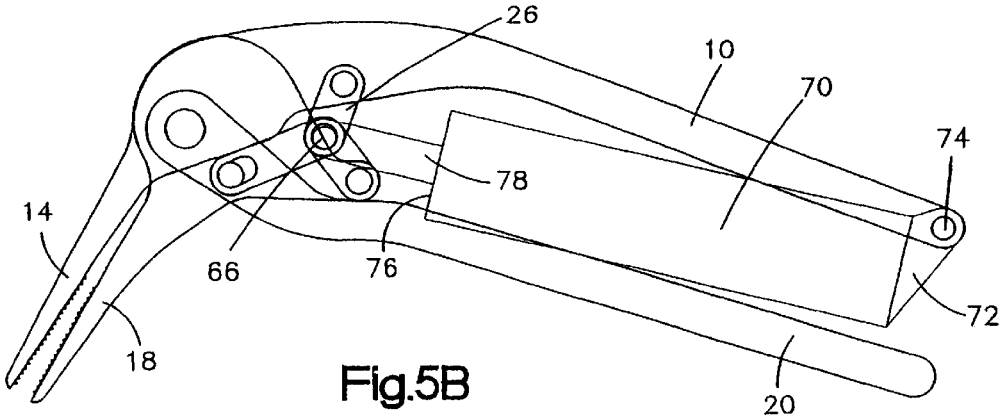
FIG. 5B is a side elevation view of the tool of FIG. 5A with the handles and jaws in an open position.

The first handle portion 12 and second handle 22 are covered with a resilient material 15, such as a high-grade foam rubber material, for comfort of the user, as is well known in the art. Second handle 22 is "U"-shaped, as depicted in FIG. 2D. The "U"-shaped handle 22 has a base 42 and first and second side walls 44*a* and 44*b*. The base 11 forms a wide and stable surface for handling the tool, thereby preventing the tool from shifting or twisting in the user's hand from the torque forces inherent in squeezing a hand tool. It also provides a stable handling surface when a power assist device is utilized with the tool, which is depicted in FIG. 5A and 5B and will be described presently.

Referring again to FIG. 2A, and to cross section view 2E, the third member 20 also has a bifurcated portion 46, the bifurcated portion having first and second arms 48*a* and 48*b*. Common pivot post 24 is disposed through and attached to the first and second arms 48*a* and 48*b*. By providing two connections to common pivot post 24, the first and second arms 48*a* and 48*b* act as two separate supportive members to provide the fulcrum for the pivoting motion of first member 10 and second member 16 about common post 24. This is an improvement in structural strength over the prior art tool depicted in FIGS. 1A and 1B.

Referring now to FIG. 2B, the four bar and pin force multiplying mechanism 26 comprises a first lever 50, a second lever 52, a third lever portion 54 formed on second member 16, and a fourth lever 56. The first lever 50 has first and second ends 5 la and 51 b respectively, and the first end 5 la thereof is pivotally connected to a first lever post 58. Said first lever post 58 is attached to the first member 10 at a point between the common pivot pin 24 and the first handle portion 12.

Figure 2E:
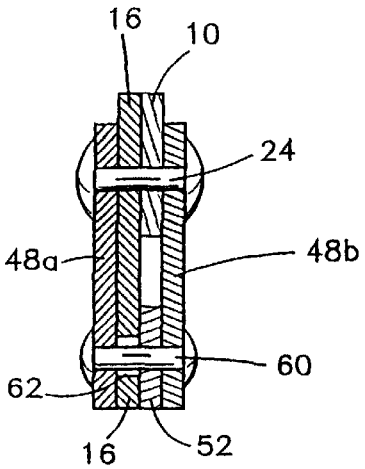
FIG. 2E is a sectional view taken substantially along the plane 2E—2E of FIG. 2A, illustrating the cooperative structure of the tool members about the common pivot pin and about the pin and lever linkage connective pin.

A second lever post 60 is attached to the bifurcated arms 48*a* and 48*b*, as depicted in FIGS. 2B and 2E. The second lever 52 further comprises first and second ends 53*a* and 53*b* respectively, the first end 53*a* thereof pivotally connected to said second lever post 60, second lever 52 being further disposed between said bifurcated arms 48*a* and 48*b*. The second lever 52 is also in sliding contact with bifurcated arm 48*a* and second member 16. Second lever 52 is further disposed within a post slot 62, said post slot 62 formed within the second member 16. The post slot 62 allows the second member 16 to pivot about common post 24 without contacting the second lever post 60 as the tool is opened and closed. Second member 16 is also in sliding contact with bifurcated arm 48*a*.

The third lever portion 54 further has an end 55, the end 55 thereof connected to a third lever post 64. Fourth lever 56 further comprises first and second ends 57*a* and 57*b* respectively, the first end 57*a* thereof pivotally connected said third lever post 64. The first lever second end 51*b*, second lever second end 53*b* and fourth lever second end 57*b* are all pivotally connected to a linking pin 66.

Referring now to FIG. 2B, when first handle portion 12 and second handle 22 are pivoted about common pivot post 24 toward each other by a user, first lever post 58 travels toward second lever post 60 a distance x. This motion is translated to first lever 50 and second lever 52, causing them to act upon linking pin 66 and force it in a proximal direction away from the common pivot post 24 a distance y. Since the travel distance y is a fraction of x, and the force applied by the user is constant, linking pin 66 travels a distance y with a multiple of the amount of applied force per distance traveled x.

The travel of the linking pin 66 is further translated by the fourth lever 56 to the third lever member post 64, thereby leveraging the applied user force further against said third lever member post 64, and thereby against attached third lever member 54. Third lever member 54 correspondingly is moved a distance z at its connection to third lever post 64. The motion of third lever member 54 thereby leverages and rotates second member 16 about common pivot post 24, and correspondingly second jaw 18 is brought towards first jaw portion 14.

Travel distance z is a fraction of travel distanced, therefore the applied user force is a multiple of the amount of applied force per travel distance y, and therefore a greater multiple of the amount of applied force per travel distance x. As the graph in FIG. 2C illustrates, the four bar and pin force multiplying mechanism 26 increases the force amplification ratio of the tool as the first handle portion 10 travels toward second handle 22.

By reversing the position of the first jaw portion 14 and the second member second jaw 18, the invention may be configured to spread said jaw portions 14 and 18 away from each other responsive to the movement of first handle portion 12 and second handle 22 toward each other. The invention can thereby exert a multiplied force to a work piece positioned about the jaws. A common embodiment of this type of tool is a piston ring spreader.

Figure 5C:
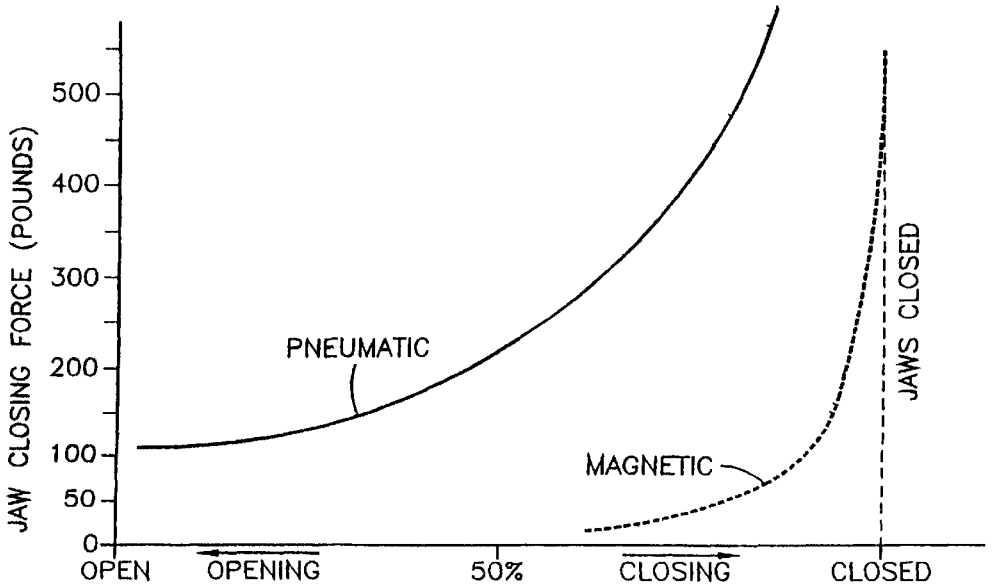
FIG. 5C is a graph depicting the relationship of Force Amplification Ratio of the tool of FIGS. 5A and 5B to the position of the tool's handles over the range of pivotal motion of the handles about the pivot pin, from open to closed.

Referring now to FIGS. 5A through 5C, one embodiment of the invention which comprises the four bar and pin force multiplying mechanism 26 and an associated power assist device 70 is shown. The power assist device 70 comprises first and second ends 72 and 76 respectively, the first end 72 thereof pivotally attached to a power assist post 74. The power assist post 74 is pivotally attached to the first handle member 10. The power assist device 70 second end 76 further comprises a powered piston 78, said powered piston 78 pivotally connected to the linkage pin 66. When a user operates the power assist device 70, the powered piston 78 is drawn into the device 70, thereby pulling the attached linkage pin 66 toward the power assist device 70. Correspondingly the four bar and pin force multiplying mechanism 26 causes the first jaw portion 14 to move toward the second jaw 18 with an amplified force. FIG. 5C illustrates how the force amplification ratios of pneumatic and magnetic embodiments of the power assist device 70 increase as the handle members 10 and 20 travel toward each other.

Another embodiment of the invention is depicted in FIGS. 3 and 3A through 3D. A first member 110 has a first handle portion 112 and a first jaw portion 114. A second member 116 has a second jaw 118, and a third member 120 forms a second handle 122. The first, second and third members 110, 116 and 120 are cooperatively joined in pivoting and sliding contact by a common pivot pin 128. The first, second and third members 110, 116 and 120 respectively are further interconnected by a cam force multiplying mechanism 130. A spring 170 is attached to the first and second handles 112 and 122. The spring 170 forces the handles 112 and 122 apart, and thereby forces the jaws 114 and 118 apart, allowing a user to insert a work piece S between the jaws 114 and 118 without requiring the user to apply force to open the jaws 114 and 118.

Figure 3:
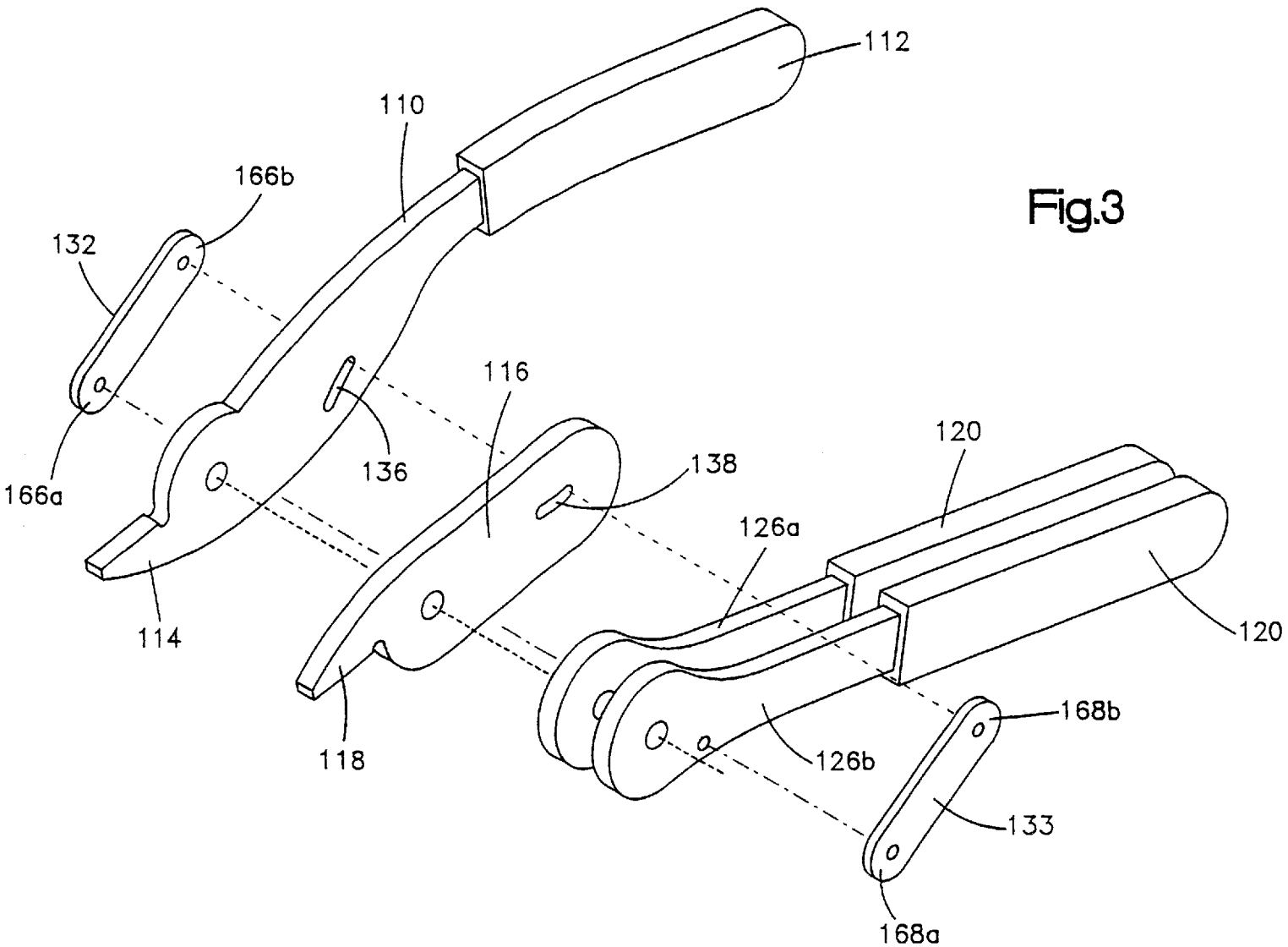
FIG. 3 is an exploded perspective view of another embodiment of the present invention.
Figure 3A:
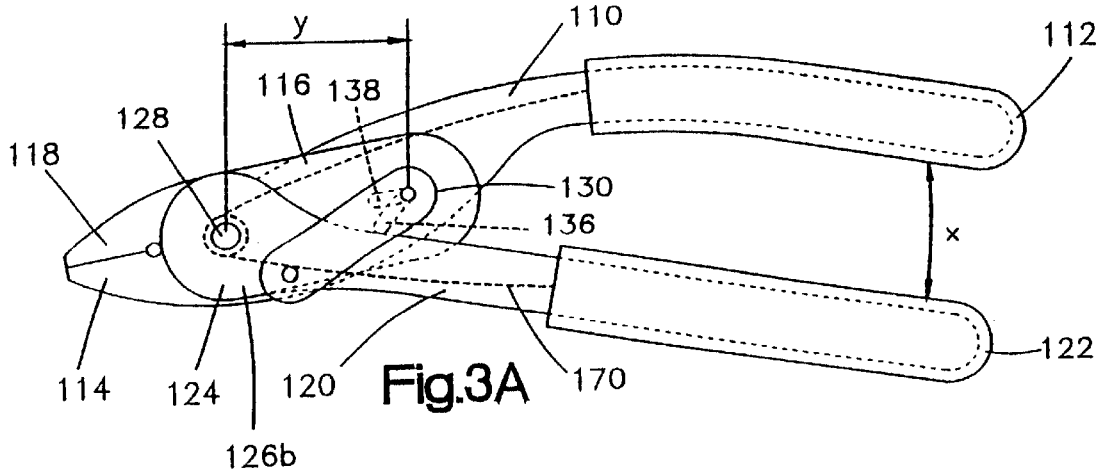
FIG. 3A is a side elevation view of the invention of FIG. 3 a force multiplying hand tool with the handles and jaws in closed positions, wherein the force multiplying mechanism is cam linkage.
Figure 3B:
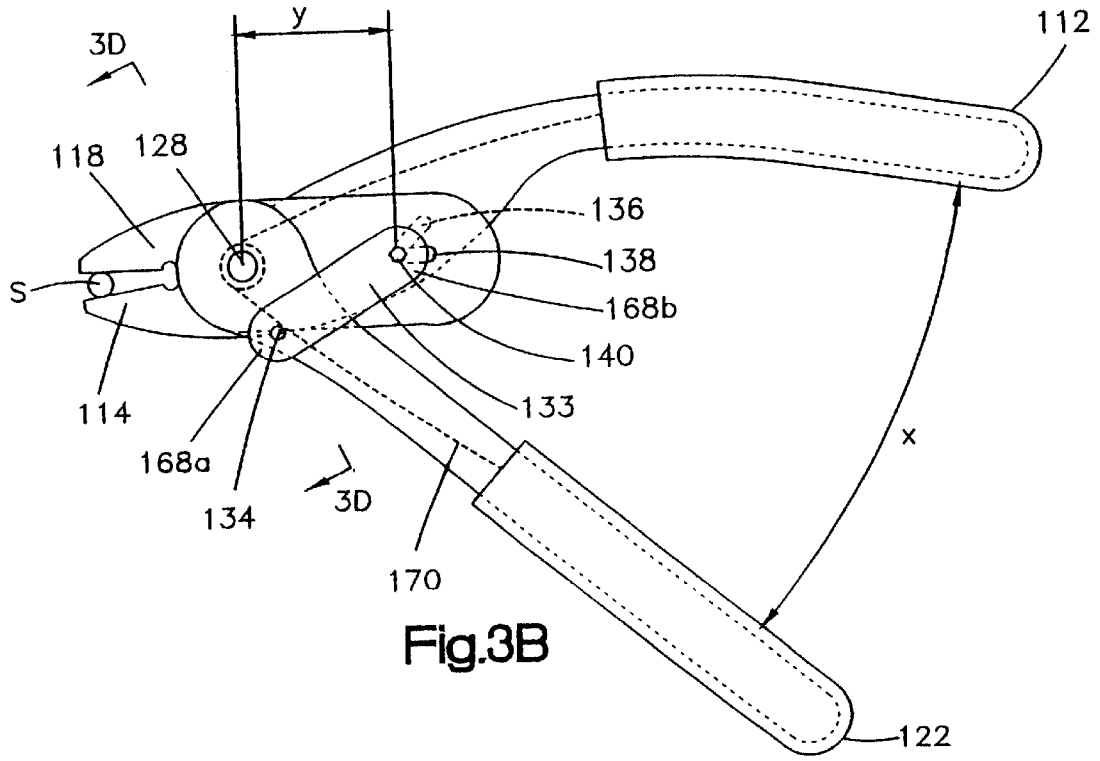
FIG. 3B is a side elevation view of the tool of FIG. 3A with the handles and jaws in an open position.
Figure 3C:
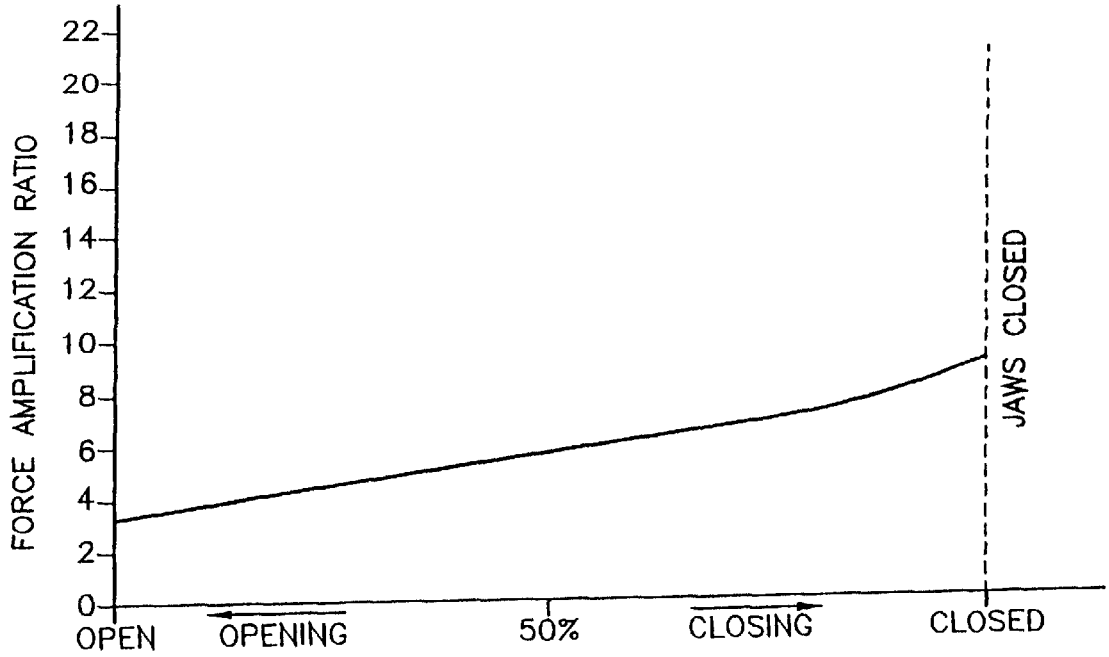
FIG. 3C is a graph depicting the relationship of Force Amplification Ratio of the tool of FIGS. 3A and 3B to the position of the tool's handles over the range of pivotal motion of the handles about the pivot pin, from open to closed.
Figure 3D:
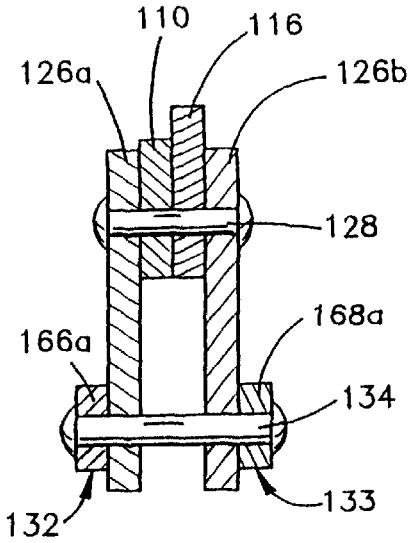
FIG. 3D is a sectional view taken substantially along the plane 3D—3D of FIG. 3B, illustrating the cooperative structure of the tool members about the common pivot pin and about the cam linkage connective pin.

Referring now to FIGS. 3A, 3B and 3D, the third member 120 further comprises a bifurcated portion 124, said bifurcated portion 124 having first and second arms 126*a* and 126*b*. The common pivot pin 128 is attached to said third member bifurcated portion arms 126*a* and 126*b*. First member 110 and second member 116 are pivotally attached to said common pivot pin 128 and disposed between said third member bifurcated portion arms 126*a* and 126*b*, all three members 110, 116 and 120 in sliding contact with each other.

The cam force multiplying mechanism 130 comprises first and second levers 132 and 133. First lever 132 has first and second ends 166*a* and 166*b*, respectively. Second lever 133 has first and second ends 168*a* and 168*b*, respectively. The first lever first end 166*a* and the second lever first end 168*a* are connected to a lever post 134. Lever post 134 is pivotally connected to the third member bifurcated portion arms 126*a* and 126*b*, said first and second levers 132 and 133 being in pivoting and sliding contact with the outer surfaces of the third member bifurcated portion arms 126*a* and 126*b* respectively.

The first member 110 and second member 116 further define first and second arcuate cam slots 136 and 138 respectively. Cam slot 136 has proximal and distal ends 137*a* and 137*b*, respectively. Similarly, cam slot 138 has proximal and distal ends 139*a* and 139*b*, respectively. A cam follower 140 is disposed through the cam slots 136 and 138, said cam follower 140 attached to the first lever second end 166*b* and the second lever second end 168*b*.

As a user operates the tool by pivoting the first handle 112 toward the second handle 122, the cam follower 140 is driven along the cam slots 136 and 138 by the first and second levers 132 and 133. The movement of the cam follower 140 along and against the second member cam slot 138 causes the second member 116 to pivot about common pivot pin 128, thereby bringing the second jaw 118 towards the first jaw 114 with an amplified force.

Figure 3E:
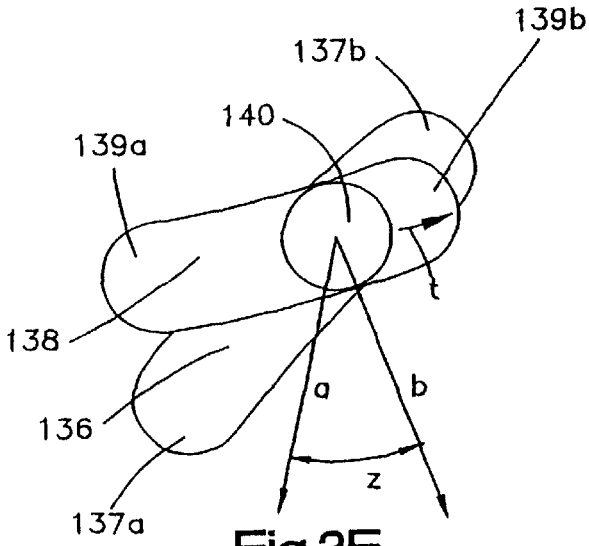
FIG. 3E is a diagrammatic representation of the second jaw cam slot and cam pin, illustrating how the angle between the direction of force b and the radial normal to the cam pin and second jaw contact a is dependent upon y, the cam pin travel distance within the second jaw slot.

The force amplification ratio of this embodiment of the invention is dependent upon the location of the cam follower 140 within the arcuate cam slots 136 and 138. Referring to FIG. 3A, 3B and 3E, as the handles 112 and 122 are brought towards each other they are separated by a diminishing distance x. As distance x decreases cam follower 140 travels toward the distal ends of the leverage slots 136 and 138, and the distance y between the pivot pin 128 and the cam follower 140 correspondingly increases. Distance y also represents the length of the second member 116 utilized as a lever in pivoting the second jaw 118 toward the first jaw 114. Accordingly, an increase in distance y results in a longer effective second member 116 lever length operated upon by cam follower 140 to pivot the second jaw 118 toward the first jaw 114. Therefore, as handles 112 and 122 are brought towards each other and thereby diminish distance x, the cam follower 140 travels distal in the slots 136 and 138, distance y increases, and thereby the leveraged force applied per distance of jaw travel increases. FIG. 3C depicts the increase in the force amplification ratio as the handles 112 and 122 approach each other.

FIG. 3E depicts how the angle z between the direction of force h and the radial normal to the cam pin and second jaw contact a is dependent upon t, the cam pin travel distance within the second member cam slot 138. The angle z is at all times greater than 5 degrees, in order to ensure a resultant force upon the cam slot 138 in a direction that will pivot the second jaw 118 with a multiplied force.

Figure 6A:
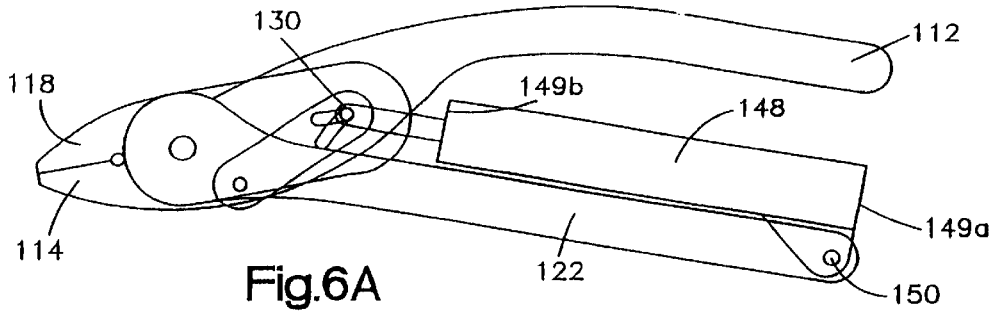
FIG. 6A is a side elevation view of a force multiplying hand tool embodying the present invention with the handles and jaws in closed positions, wherein the force multiplying mechanism is pin and lever linkage, the tool further incorporating a power assist device.
Figure 6B:
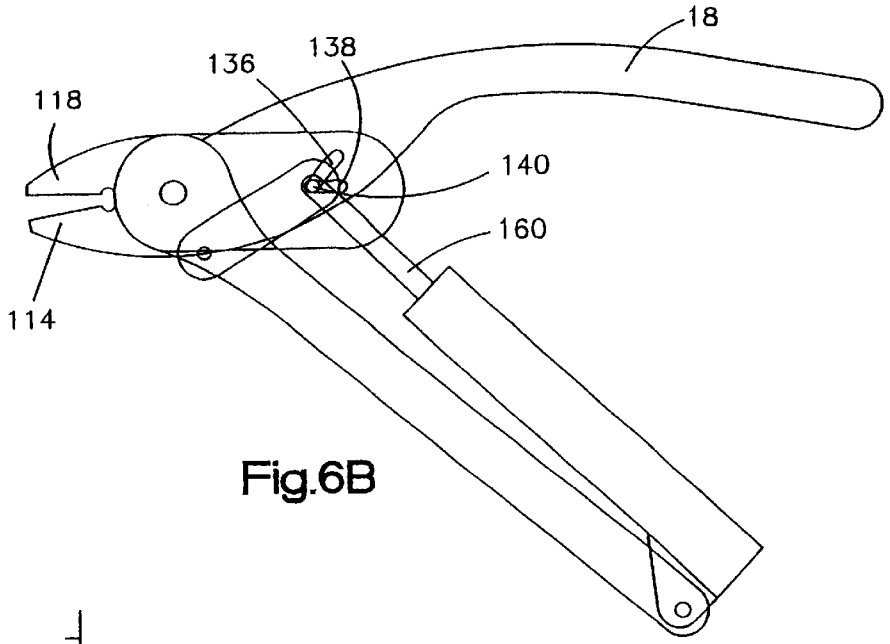
FIG. 6B is a side elevation view of the tool of FIG. 6A with the handles and jaws in an open position.
Figure 6C:
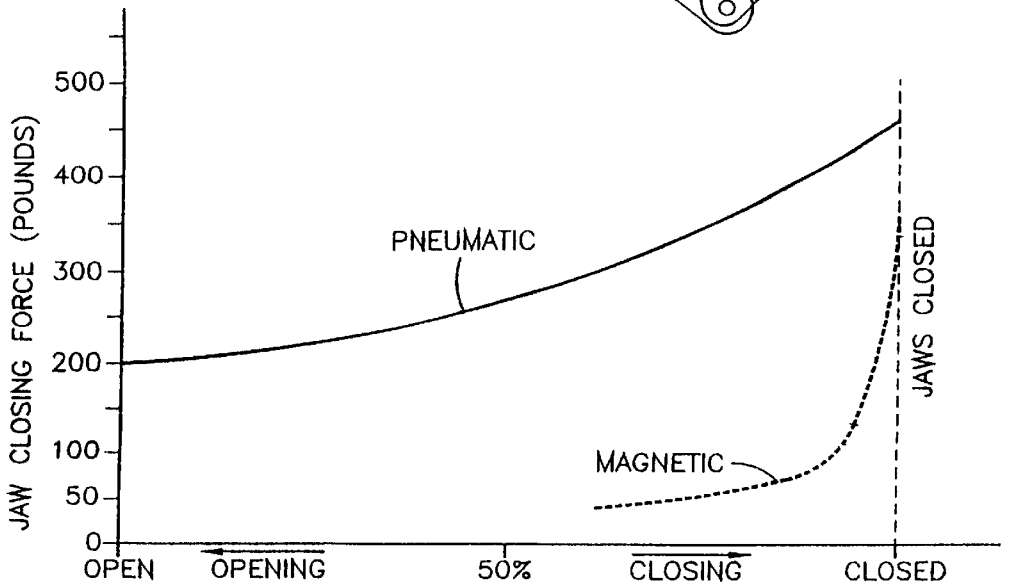
FIG. 6C is a graph depicting the relationship of Force Amplification Ratio of the tool of FIGS. 6A and 6B to the position of the tool's handles over the range of pivotal motion of the handles about the pivot pin, from open to closed.

FIGS. 6A through 6C depict an embodiment of the invention comprising the cam force multiplying mechanism 130 and an associated power assist device 148, said power assist device 148 further having first and second ends 149*a* and 149*b*, respectively. The power assist device 148 is pivotally attached at its first end 149*a* to a power assist post 150. The power assist post 150 is attached to the second handle member 122. A piston 160 extends from the power assist device second end 149*b* and pivotally attaches to a cam pin 162. When operated by a user, the power assist device 148 draws the piston 160 into the power assist device 148. The cam follower 140 is thereby drawn distally through and against arcuate cam slots 136 and 138, as illustrated in the cam force multiplying mechanism tool embodiment described above. The force amplification ratio of the power assisted cam force multiplying mechanism in relation to the distance between the first handle 112 and the second handle 122 is depicted in FIG. 6C for exemplary pneumatic and magnetic power assist devices.

Figure 7:
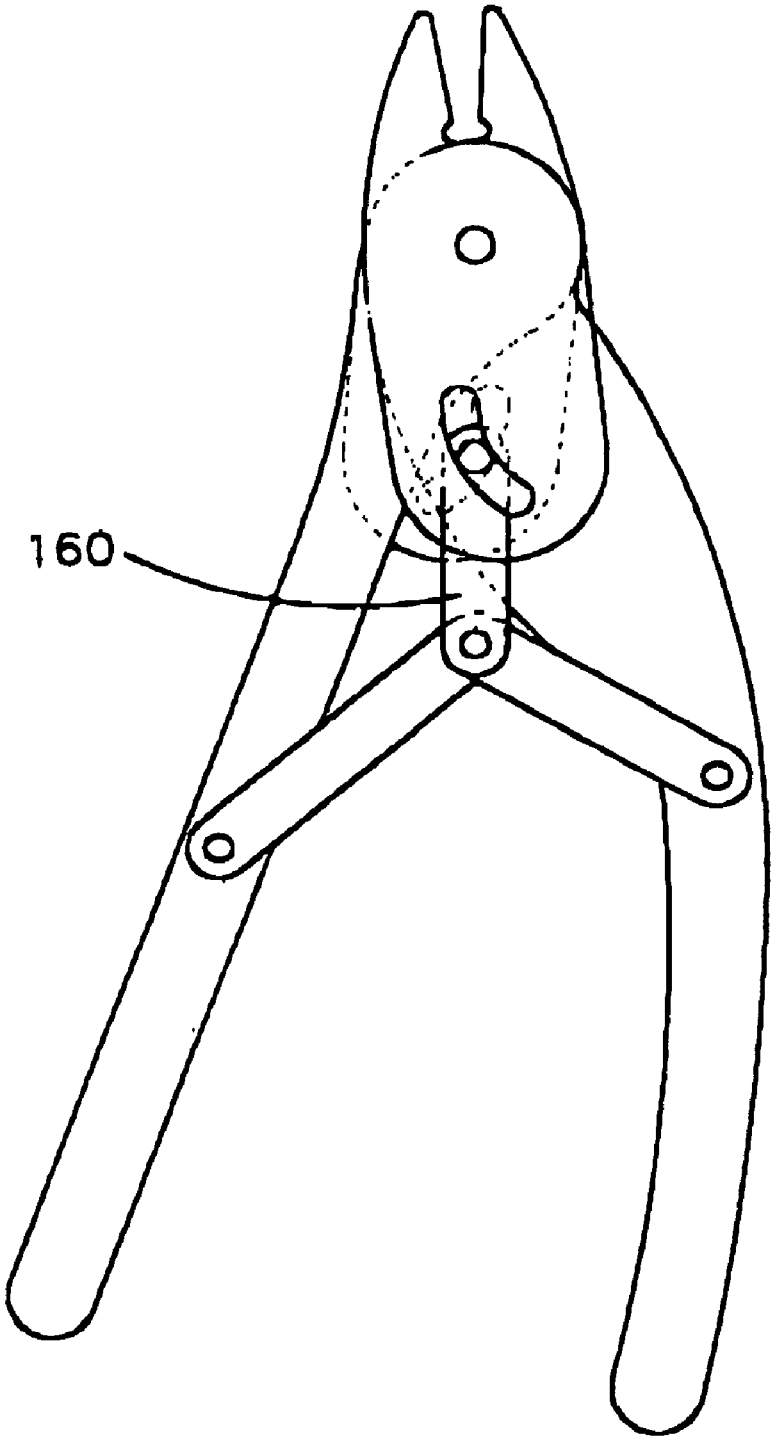
FIG. 7 is a side elevation view of a force multiplying hand tool embodying the present invention with the handles and jaws in an open position, wherein the force multiplying mechanism is combination of the pin and lever linkage and the cam linkage.

FIG. 7 depicts another embodiment of the invention wherein the force multiplying mechanism 160 is a combination of a cam linkage and a pin and lever linkage.

What is claimed is:

1. A force multiplying hand manipulated tool, comprising:

a. first, second, and third members pivotally interconnected by a common pivot pin;

b. said first member having a jaw portion and a handle portion;

c. said second member having a jaw portion;

d. said third member having a handle portion;

e. said common pivot pin pivotally interconnecting said three members to provide pivotable movement of the jaw portions toward and away from each other responsive to pivotable movement of said handle portions toward and away from each other; and f. a force multiplying mechanism interconnecting said three members wherein said force multiplying mechanism is configured to increase an applied force of the jaws on a work piece responsive to said pivotable movement of the handle members toward each other.

2. The force multiplying hand tool of claim 1, wherein the force multiplying mechanism comprises at least one cam surface carried by at least one of the members and a cam follower carried by the force multiplying mechanism.

3. The invention as defined in claim 2 wherein the first member carries a first cam surface and the second member carries a second cam surface.

4. The invention as defined in claim 2 wherein said cam follower is a pin.

5. The invention as defined in claim 2 wherein at least one cam surface is arcuate.

6. The invention as defined in claim 2 wherein the force multiplying mechanism further comprises:

a. first and second levers, each having first and second ends, the first lever ends being pivotally connected to said third member;

b. a first cam slot formed in said first member; and c. a second cam slot formed in said second member, wherein said cam follower is attached to the second lever ends and projects through the first and second pin cam slots.

7. The force multiplying hand tool of claim 1, wherein the force multiplying mechanism comprises a lever arrangement and a mechanism pin in driving relationship with said lever arrangement.

8. The tool of claim 7, wherein the force multiplying mechanism comprises:

a. A first lever with first and second ends, the first end thereof pivotally attached to said first member;

b. a second lever with first and second ends, the first end thereof pivotally attached to said third member;

c. a third lever with one end, formed on the second member, and d. a fourth lever with first and second ends, the first end thereof pivotally attached to the third lever end;

e. wherein the fourth lever second end, first lever second end and the second lever second end are commonly pivotally connected to said mechanism pin.

9. The force multiplying hand tool of claim 1, wherein at least one handle portion further comprises a bifurcated end portion, wherein said common pivot pin is attached to said bifurcated end portion.

10. The force multiplying hand tool of claim 1, wherein at least one handle portion is "U"-shaped.

11. The tool of claim 1 further comprising a spring attached to said first and third members wherein said handle portions are forced apart from each other by said spring.

12. The tool of claim 1 further comprising a power assist device connected to said force multiplying mechanism, wherein force applied to said force multiplying mechanism by the power assist device moves said jaw portions toward and away from each other.

13. The tool of claim 12 wherein the power assist device is a pneumatic device.

14. The tool of claim 12 wherein the power assist device is an electromagnetic device.

15. A force multiplying hand tool, comprising:

a. a lower handle having a proximal end and a distal end, the lower handle proximal end formed for manipulation by hand;

b. two lower handle distal members formed at the lower handle distal end, the distal members further defining a lower handle slot therebetween;

c. a pivot post attached to the lower handle distal members and disposed through said lower handle slot;

d. an upper handle having a proximal end and a distal end, the upper handle proximal end formed for manipulation by hand, the upper handle distal end disposed between the lower handle distal members and pivotally connected to the pivot post;

e. a first jaw formed at the upper handle distal end, the first jaw distal to the pivot post connection, the first jaw further having a work piece contact surface;

f. a second jaw member having a distal end and a proximal end, the second jaw member pivotally connected to the pivot post at a point between the second jaw member distal and proximal ends, the second jaw distal end further forming a work piece contact surface facing the first jaw work piece contact surface;

g. a mechanism post attached to the lower handle distal members and disposed through said lower handle distal slot, the mechanism post located on the lower handle at a point between the pivot post and the proximal end; and h. a force multiplying mechanism, the force multiplying mechanism connected to the upper handle at a point between the upper handle pivot post connection and the upper handle proximal end, the force multiplying mechanism also pivotably connected to the mechanism post, and the force multiplying mechanism lastly connected to the second jaw at the second jaw proximal end, wherein a force applied to pivot at least one of the handles about its pivot post connection toward the other handle is received by the force multiplying mechanism and multiplied and applied by the force multiplying mechanism to the second jaw, the second jaw and second first jaw work piece contact surface thereby pivoted toward the first jaw and first jaw work piece contact surface respectively with a force that is a multiple of the applied force, and wherein the multiplied force progressively increases as the handles travel toward each other.

16. The invention as defined in claim 1, wherein the jaws move away from each other responsive to the handles moving toward each other, thereby applying force to a workpiece located about said jaws.

17. The invention as defined in claim 1, wherein the jaws move toward each other responsive to the handles moving toward each other, thereby applying force to a workpiece located between said jaws.

* * * * *